United States Patent [19]

Schebece

[11] 4,181,632

[45] Jan. 1, 1980

[54] ELASTIC DETERGENT BAR

[75] Inventor: Frank Schebece, Edison, N.J.

[73] Assignee: Colgate-Palmolive Company, New York, N.Y.

[21] Appl. No.: 746,999

[22] Filed: Dec. 2, 1976

[51] Int. Cl.[2] ..... C11D 1/50; C11D 17/00; C11D 1/12; C11D 1/94

[52] U.S. Cl. ..... 252/542; 252/DIG. 5; 252/DIG. 16; 252/174; 252/545; 252/548

[58] Field of Search ..... 252/134, 132, 121, 122, 252/117, 108, 174, DIG. 5, 16, 542, 142, 545

[56] References Cited

U.S. PATENT DOCUMENTS

| | | | |
|---|---|---|---|
| 3,442,812 | 5/1969 | Barnhurst | 252/DIG. 16 |
| 3,689,437 | 9/1972 | McLaughlin | 252/335 |
| 3,708,425 | 1/1973 | Compa et al. | 252/DIG. 16 |

FOREIGN PATENT DOCUMENTS

| | | | |
|---|---|---|---|
| 731396 | 6/1955 | United Kingdom | 252/DIG. 16 |
| 1194861 | 6/1970 | United Kingdom | 252/DIG. 16 |

*Primary Examiner*—George F. Lesmes
*Assistant Examiner*—E. Rollins Buffalow
*Attorney, Agent, or Firm*—Herbert S. Sylvester; Murray M. Grill

[57] ABSTRACT

An elastic detergent bar, useful as a functional article and bath plaything, includes a synthetic organic detergent, which is either an anionic detergent or an amphoteric detergent, gelatin and water. When the synthetic anionic detergent is employed a cross-linking or denaturing agent for the gelatin is also present. The articles made, in bar or cake form, are useful detergents and substantially form-retaining.Although they wear away somewhat during use they retain their general shapes and elasticities for major proportions of their useful lives. They are easily manufactured and molded or otherwise shaped to final form, are moldable to finely figured and detailed shapes and are resistant to breakage during shipping and use.

10 Claims, No Drawings

ELASTIC DETERGENT BAR

This invention relates to elastic detergent bars. More particularly, it relates to detergent bars intended for conventional toilet soap uses, either as hand soaps or bath or shower soaps, which are elastic in nature, giving them unique tactile properties, such as "squeezability", which makes them like a plaything for children, thereby making bathing more pleasant.

A wide variety of materials has been incorporated into soap and synthetic detergent compositions. Soap bars have included perfumes, colorants, abrasives, bleaches, fillers, emollients and bodying agents and among the bodying agents gelatin is one that has been utilized in the past. Soap bars have usually contained a lower polyhydric alcohol, such as glycerol and additionally, water, both of which are produced and utilized in the soapmaking process. In U.S. Pat. No. 2,360,920 there are disclosed soap buds made from an aerated aqueous solution of soap containing glycerin and a demulcent, such as may be made from a mixture of Irish moss and gelatin. U.S. Pat. No. 3,689,437 teaches the manufacture of malleable and non-hardenable detergent products from certain percentages of a fatty acid isethionate, water, gelatin and hydrocarbon, with a filler being optionally present. The resulting bars, which may also contain glycerol or propylene glycol and other adjuvants, are said to be moldable and extrudable but not elastic (apparently the elasticity is destroyed upon incorporation of the isethionate into the composition). British Pat. No. 731,396 describes the manufacture of a shaped organic soapless detergent composition in which the organic soapless detergent, such as triethanolamine alkylbenzene sulfonate, is dispersed in a gelatin gel. Aeration of the gel to produce a frothy product is suggested, as are the additions of various builders, fillers, nonionic detergents, etc.

Although the prior art has recognized that gelatin may be included in detergent compositions which may be desirably molded or shaped to bar or cake form, the teachings of the art, as a whole, do not result in bars satisfying applicant's standards, which require that bars maintain elasticity during use and be form-retaining and sufficiently resistant to breakage and distortion during shipping and storage so as to be received by the ultimate customer in acceptable condition, preferably being received exactly as made.

By means of the present invention improved elastic detergent bars are made, which include gelatin and water and in which the synthetic organic detergent is an anionic detergent with cross-linking agent and/or denaturing agent present or is an amphoteric detergent. In accordance with the present invention an elastic detergent bar comprises, in the case of the bar based on anionic detergent, about 10 to 80% of a synthetic organic detergent, about 5 to 30% of gelatin, about 0.1 to 5% of a cross-linking agent and/or denaturing agent for the gelatin and about 5 to 60% of water, and when the amphoteric detergent is employed, comprises about 10 to 70% of amphoteric synthetic organic detergent, about 5 to 30% of gelatin and about 5 to 60% of water.

The anionic synthetic organic detergents of this invention include sulfated, sulfonated and phosphonated hydrophobic moieties, especially those which include higher hydrocarbyl groups (preferably fatty), such as alkly groups of 8 to 20 carbon atoms, preferably of 10 to 18 carbon atoms. These compounds are usually employed as their water soluble salts, such as salts of alkali metals, e.g., sodium, potassium and triethanolamine and ammonia. For the present compositions these salts will usually be either sodium, potassium or triethanolamine salts and of these the triethanolamine (or triethanolammonium) salts will often be preferred. Among the various types of synthetic anionic organic detergents which may be useful are the linear higher alkylbenzene sulfonates, especially those of 12 to 15 carbon atoms, e.g., sodium linear tridecylbenzene sulfonate; paraffin sulfonates; olefin sulfonates; higher fatty alcohol sulfates; monoglyceride sulfates, especially the sulfated monoglycerides of coconut oil, tallow, hydrogenated coconut oil, hydrogenated tallow and synthetic higher fatty acids of 8 to 20 carbon atoms, e.g., sodium coconut oil monoglyceride sulfate, ammonium cocomonoglyceride sulfate; corresponding sulfates and phosphonates and other equivalent organic sulfonates, in most of which the lipophilic group includes a chain of 10 to 18 carbon atoms. Additionally useful are the sulfates and sulfonates of nonionic detergents and of nonionic surface active agents, in which products the nonionic base will normally be a polyethylene oxide condensation product of a higher fatty alcohol, such as a condensation product based on a higher fatty alcohol of 10 to 18 carbon atoms, wherein the ethylene oxide content is from 3 to 30, preferably 5 to 10 or 12 mols of ethylene oxide per mol of higher fatty alcohol. A specifically preferred anionic detergent is ammonium monoglyceride sulfate of 8 to 18 or 20 carbon atoms in the fatty acid group, e.g., ammonium cocomonoglyceride sulfate (coco indicates derivation of the fatty acids from coconut oils), although alkali metal monoglyceride sulfates, such as sodium monoglyceride sulfate, are also useful. While sodium lauryl sulfate is an anionic synthetic organic detergent which may be employed, preferably in minor proportion with other anionic synthetic organic detergents in the present compositions, its use is usually not preferably and the corresponding triethanolammonium salt is normally used instead because it produces a bar of good washing and foaming ability which is also stable on storage and maintains its elasticity during use. The ammonium and tri-lower alkanolammonium salt detergents also aid in making a clear product rather than a cloudy one, which often results when metal salts, such as alkali metal salts, are used, and it is usually considered to be desirable for the present detergent articles to be clear.

The amphoteric detergents which may be utilized to manufacture the elastic detergent bars of this invention include such compounds as Deriphat® 151, which is sodium N-coco-betaaminopropionate (manufactured by General Mills, Inc.) and other betaaminopropionates and betaiminodipropionates, such as sodium N-lauryl betaiminodipropionate, Miranol® $C_2M$ (anhydrous acid form, 1-carboxymethyl-1-carboxyethoxyethyl-2-coco-imidazolinium betaine), the water soluble salts thereof, especially the triethanolammonium salt, and other imidazolinium betaines, and other of the various known amphoterics, described in McCutcheon's *Detergents and Emulsifiers,* 1973 Annual and in *Surface Active Agents,* Vol. II, by Schwartz, Perry and Berch (Interscience Publishers, 1958), the descriptions of which are incorporated herein by reference. For example, Deriphats 151C, 154, 160, 160-C and 170-C, and Miranols $C_2M$, S2M and SHD Conc. may be employed. Additionally, even liquid amphoteric detergents may be used, at least in part, e.g., up to 25 or 50% of the total amphoteric detergent content. The recited incorporated references also contain extensive descriptions of various suitable anionic detergents and of nonionic and cationic detergents which may be employed in small proportion(s) in the present compositions. The various long chain substituents in the mentioned amphoterics are of 8 to 20 carbon atoms, preferably of 10 to 18 carbon atoms and most preferably are lauryl and coco.

The nonionic detergents, while not required components of the invented products, may be present in relatively small proportions therein in replacement of some of the anionic or amphoteric detergents. The nonionics are preferably solid or semi-solid at room temperature, more preferably solid, and include but are not limited to ethoxylated aliphatic alcohols having straight or branched chains (preferably straight chain) of from about 8 to 20 carbon atoms, with about 3 to about 30 ethylene oxide units per molecule. Particularly suitable nonionic detergents of such type are manufactured by Shell Chemical Company and are marketed under the trademark Neodol ®. Of the various Neodols available, Neodol 25-7 (12–15 carbon atoms chain higher fatty alcohol condensed with an average of 7 ethylene oxide units per mol) and Neodol 45-11 (14–15 carbon atoms chain higher fatty alcohol condensed with an average of 11 ethylene oxide units per mol) are particularly preferred. Another suitable class of ethoxylated aliphatic alcohol detergents is made by Continental Oil Company and is sold under the trademark Alfonic ®. Of the Alfonics the most preferred is Alfonic 1618-65, which is a mixture of 16 to 18 carbon atoms primary alcohols ethoxylated so as to contain 65 mol percent of ethylene oxide. Additional examples of nonionic synthetic organic detergents include those marketed by BASF Wyandotte under the trademark Pluronic ®. Such compounds are made by condensation of ethylene oxide with a hydrophobic base formed by condensing propylene oxide with propylene glycol. The hydrophobic portion of the molecule has a molecular weight of from about 1,500 to 1,800 and the addition of polyoxyethylene (or ethylene oxide) to such portion increases the water solubility of the molecule as a whole, with the detergent being a solid at room temperature when the polyoxyethylene content is above 50% of the total weight of the condensation product. Such a nonionic detergent is Pluronic F-128 but F-68 may also be employed. Also useful nonionic detergents are the polyethylene oxide condensates of alkyl phenols, such as the condensation products of such compounds wherein the alkyl group contains about 6 to 12 carbon atoms, in either a straight chain or branched chain configuration, with 5 to 25 mols of ethylene oxide per mol of alkyl phenol. The alkyl substituents in such compounds may be derived from polymerized propylene or may be diisobutylene, octene or nonene, for example.

Representative cationic detergents, which usually also possess antibacterial (and fabric softening) properties, include di-higher alkyl di-lower alkyl ammonium halides such as distearyl dimethyl ammonium chloride, and 2-heptadecyl-1-methyl-1-[(2-stearoylamido)ethyl]-imidazolinium methyl sulfate. The higher alkyls thereof are of 8 to 20 atoms, preferably 12 to 18 and the lower alkyls are of 1 to 4 carbon atoms, preferably 1 and 2. Such materials are normally omitted from anionic detergent-based products but may be employed in small proportions in amphoteric-based elastic detergent bars.

Gelatin, a complex mixture of collagen degradation products of molecular weight in the range of about 30,000 to 80,000 and higher, depending on the hydrolytic conditions to which it has been subjected, is a vital constituent of the present compositions. Apparently because of its outstanding ability to form reversible gels, its high viscosity and the excellent strengths of films thereof, it helps to make a detergent bar which is of satisfactory strength and cleaning power, due to gradual dissolution of the ordinarily extremely soluble synthetic organic detergent component, and yet, which does not produce objectionable and unacceptable soft gels at bar surfaces which have been moistened. Additionally, and a major advantage of the present invention, the combination of gelatin and synthetic organic detergent, in the presence of water and preferably also in the presence of a lower dihydric or polyhydric alcohol or other suitable plasticizer, and in the case of anionic synthetic organic detergents, in the presence of a cross-linking agent and/or a denaturant, yields elastic products. The elastic detergent bars made are sufficiently elastic so that a bar 2 cm. thick can be wetted and pressed between thumb and forefinger to a 1 cm. thickness and will immediately (within five seconds) return to the 2 cm. thickness or at least to within 1 mm. thereof, upon pressure release.

The gelatin employed is essentially colorless and free from odor. It is amphoteric (about 45 milliequivalents of amino functions and about 70 milliequivalents of carboxyl functions per hundred grams thereof). It is normally used in formulating as a dry granular product which is crystalline in appearance although it is really amorphous. It is insoluble in cold water but swells rapidly in the presence of water until it has imbibed about 6 to 8 times its weight thereof and it melts to a viscous solution in water when warmed to above 40° to 45° C. Gelatins are classified as either type A or type B, the former being from acid-cured stock, with an isoelectric point of about 8.3–8.5 and the latter being of alkali-cured stock, with an isoelectric point of about 4.8–5.0. Type A gelatins are preferred for the present applications but type B gelatins may also be used, as may be mixtures of the two. The gelling powers of gelatins are normally measured by the Bloom test. Often too, viscosity will also be employed to characterize a gelatin and a gel strength: viscosity ratio may be specified, e.g., 3:1 to 5:1. Gel strengths will range from 100 to 300 g. Bloom but will usually be in the range of 150 or 200 to 300, with gelatins of Bloom values of 225 g. and 300 g. being employed in the examples herein. The type A gelatins will generally be utilized with the usual detergent bar constituents, normally intended for employment in neutral or slightly basic aqueous media, and the type B gelatins will be preferred when acidic conditions are expected to be encountered (the present examples include type A).

Cross-linking agents for gelatin and for other proteins are metal salts which cross-link various gelatin molecules, apparently by reacting with free carboxyl functions thereof. This class of compounds is well known and the salts employed are usually those of aluminum, calcium, magnesium and/or zinc that are soluble in aqueous media. In such salts the preferred anions are chloride, bromide, iodide, sulfate, bisulfate and acetate but other suitable anions may also be included. Examples of such salts include potassium aluminum sulfate hydrate [alum, $KAl(SO_4)_2.12H_2O$], aluminum chloride, other alums, calcium chloride, magnesium sulfate and zinc acetate. Also useful as for cross-linking is formaldehyde, usually as formalin. 0.1 TO 1% of formaldehyde is normally adequate. Although the presence of a cross-linking agent is often highly desirable in the formulations of the invented bar compositions, especially those based on anionic detergents, it has been found that such are not needed and sometimes may be objectionable in detergent bars in which amphoteric detergents are the major detersive components.

Instead of or in addition to a cross-linking agent there may be employed with the gelatin of the present compositions a denaturant. Such a compound also helps to reduce solubility of gelatin at and near its isoelectric point and inhibits crystallization. Although denaturation may be effected by various materials, including various detergents, ethanol, acetone, strong acids and strong alkalis, chemical denaturation, such as by urea, dextrose or guanidine hydrochloride, is preferred and of these compounds the urea is much preferred. Both cross-linking and denaturation and the combination thereof are helpful in producing a lastingly elastic detergent bar of desired properties, suitable for repeated and satisfactory cleaning applications.

The lower dihydric and/or polyhydric alcohol component(s) of the present bars functions as a mutual solvent and plasticizer for the bar components, especially the gelatin. It facilitates solubilization of the detergent at a desired rate and maintains the surface of the bar soft. If the bar became objectionably hard at portions thereof this could be cause for rejection of it by consumers. Such alcohol also helps to distribute the various components evenly throughout the bar or cake. Although a variety of lower dihydric or polyhydric alcohols may be employed, including various sugars and sugar alcohols, having up to 6 carbon atoms and up to 6 hydroxyls per molecule, the most preferred are those of 2 to 3 carbon atoms and 2 to 3 hydroxyl groups per molecule. Such compounds include propylene glycol (1,2-dihydroxypropane or 1,2-propylene glycol), trimethylene glycol (1,3-propylene glycol) and glycerol, of which 1,2-propylene glycol, glycerol and mixtures thereof are preferred. Other useful solvents are the Cellosolves®, the mono- and di-lower alkyl ethers of ethylene glycol. Additionally, sometimes monohydric alcohols, such as ethanol are useful, primarily as supplementary solvents.

The water employed is preferably deionized water which will normally contain less than 10 parts and preferably less than 1 part per million of hardness, as calcium carbonate, but normal city waters may also be utilized, such as those having hardnesses in the range of 10, 20 or 50 to 150 or 300 p.p.m., as $CaCO_3$.

With the basic elastic detergent bar composition there may be present various adjuvant materials in minor proportions to contribute their particular properties to the final product. Among such adjuvant materials are functional and aesthetic adjuvants, such as: perfumes; pigments; dyes; optical brighteners; skin protecting and conditioning agents, e.g., lanolin, solubilized lanolins; bactericides; chemical stabilizers, e.g., sodium bisulfite; foam stabilizers, e.g., lauric myristic diethanolamide; buffering agents and pH adjusters, e.g., triethanolamine, hydrochloric acid, phosphates; bodying agents, e.g., clays; superfatting agents, e.g., stearic acid; anti-redeposition agents and soil dispersants, e.g., polyvinyl alcohol, sodium carboxymethyl cellulose; gums, e.g., sodium alginate, which also functions as a slip improving agent; and abrasive or scouring components, e.g., silex. Usually the present bars do not and should not contain any fillers or builder salts other than those which may accompany, usually unavoidably, other components of the product. However, in certain circumstances, as when bars for heavy duty laundry use are made, it may be desirable to add fillers, such as sodium sulfate and sodium chloride and builder salts, such as pentasodium tripolyphosphate, sodium carbonate and sodium silicate.

The proportions of the various components of the present elastic detergent bars should be kept within ranges to be given to obtain the best results and to produce a bar which will be desirably elastic, useful in place of conventional soap, soap-detergent and detergent bars and which will possess improved properties, such as a lesser tendency to slough when in contact with water, compared to such more conventional bars. The synthetic organic detergent component, preferably either an anionic detergent or a mixture thereof or an amphoteric detergent or mixture thereof (with the anionic detergent-based composition also containing cross-linking agent and/or denaturant) will be about 10 to 80% of the product, preferably 15 to 50% and more preferably about 20 to 25% thereof. When an anionic detergent is employed there will be present in the bar about 0.1 to 5% of a cross-linking agent and/or denaturing agent for the gelatin, preferably 1 to 3% and more preferably about 1 or 2% thereof. The gelatin, preferably type A gelatin of 225 to 300 g. Bloom, will be about 5 to 30%, preferably 7 to 25% and more preferably about 10 to 20% of the finished bar or cake and the moisture content will be about 5 to 60%, preferably 5 to 45% and more preferably 25 to 45%, e.g., 40%.

The lower dihydric or polyhydric alcohol, which may be omitted if syneresis problems are encountered (usually due to a high percentage of normally liquid components of the product), will normally be present in the range of 3 to 20%, preferably 10 to 18%, e.g., 15%.

The total proportion of various adjuvants present, including any builders and fillers, will normally not exceed 10%, preferably will be less than 5% and more preferably will be less than 2%, with the proportion of any particular adjuvant usually being held to less than 5%, preferably less than 2% and more preferably less than 1%.

The manufacture of the present elastic detergent bars is comparatively simple, requiring only the mixing together of the components under such conditions that the gelatin will form a gel with water and/or with any other components present. For example, all the components of a particular detergent composition may be mixed together and heated, with stirring, to dissolve the gelatin. Alternatively, the gelatin may be first dissolved in water and the other components may then be admixed or other operative mixing sequences may be adopted. If the components are soluble the product may be transparent or at least transluscent but if insoluble ingredients are employed, which may be done intentionally, an opaque gel results. To clarify transparent gels and to increase the strengths and densities thereof these may be deaerated or degassed under vacuum or by allowing the hot or warm liquid to stand until it becomes clarified. The solution or dispersion may then be poured into suitable molds, chilled and thereby solidified. Although gelatin dissolves at temperatures above 40° or 45° C. it is normally undesirable to heat it to a temperature above 100° C. and preferably dissolving will take place at a temperature in the range of about 50° to 90° or 95° C., more preferably about 60° to 80° C., over 3 to 30 minutes. Molds will usually be at a temperature of 5° to 20° C., preferably 5° to 15° C. After the gelatin has completely set, which may take from about one minute to an hour, usually taking from three to ten minutes, the elastic detergent bar or cake may be removed from the mold and packed or it may be allowed to be warmed to room temperature before packing, at which temperature it still remains firm, yet elastic.

The elastic detergent bars of this invention possess an obvious novelty advantage over ordinary soap or detergent bars. They are especially attractive to children when molded into various special shapes, such as the shapes of storybook or cartoon characters, animals, etc., and promote the enjoyment of bathing by infants and young children. The elastic nature of the product allows a controlled dispensing of detergent and other foaming materials onto the skin or into the bath water in response to repeated squeezings and relaxings of the bar. Thus, the utilitarian detergent is also a delightful toy. However, the product has various other advantages apart from its play value. Thus, the presence of the gelatin adds a skin care ingredient to the composition and because of the bar's elasticity breakage during shipment and on storage are minimized. The bar holds its original size longer and physically (by contact) assists in better removal of dirt from the skin during use. Furthermore, large quantities of synthetic organic detergent may be present in the composition without the need for extensive use of waxes, plasticizers, bodying agents, etc. to control the dissolving thereof and give them desirable tactile properties and good appearances. The bars do not slough excessively, as often do detergent and soap bars, and additionally, they maintain substantially their original shapes during use, continually dispensing detergent in response to compression and expansion and rubbing against areas to be cleansed. They have a different "feel" than soap when contacting the skin and this better contact assists in cleaning. The detergents in the bars or other shaped articles are readily released at temperatures of 25° to 40° C. and higher and for cold water washing, at temperatures of 10° C. and less, more soluble and lower Bloom value gelatins can be employed, with appropriate solvents and adjuvants, to help release the detergent.

It is to be understood that within the proportions of components given variations may be made and should often be made to best promote desired properties of the bars manufactured and similarly, processing modifications may also be made. Thus, if an amphoteric detergent-based bar should tend to harden on the surface thereof after use so that the amount of detergent released is diminished and elasticity is adversely affected an increase in the content of plasticizing material and/or water and a decrease in gelatin and cross-linking agent, if present, may be desirable. Similarly, when the product made is too elastic or infirm an increase in the solids content thereof might desirably be effected, together with diminutions in the contents of water and plasticizer. Also possible is to modify the type of gelatin employed, increasing or diminishing its Bloom value so as to modify the characteristics of the final product and the proportions and types of cross-linking agent and denaturant, if present, may be adjusted to control the properties of the finished cake. Those of skill in the art, with this specification before them, will be able to modify the properties of the described compositions to make them adhere to standards imposed.

The following examples illustrate but do not limit the invention. Unless otherwise indicated all temperatures are in °C. and all parts are by weight.

EXAMPLE 1

| | Percent |
|---|---|
| Gelatin (225 g. Bloom, Type A) | 10.5 |
| Glycerin | 15.8 |
| Sucrose | 7.9 |
| $KAl(SO_4)_2 \cdot 12 H_2O$ | 1.6 |
| Hydrochloric acid (50% by volume aqueous solution) | 1.1 |
| Deriphat 160C (30% aqueous solution of the partial sodium salt of N-lauryl betaimiodipropionate, mfd. by General Mills, Inc.) | 63.1 |

The components of the above formula are blended together and are heated with stirring at a temperature in the range of 60° to 80° C. to dissolve the gelatin and the various other materials. After about 5 to 10 minutes a clear solution or gel is obtained, which is poured into shaped molds and chilled to 15° C. After solidification, which takes about 8 minutes, the elastic detergent bar or cake is removed from the mold and is ready for use.

The product is satisfactorily elastic and cleans well, when employed as a bath or hand "soap", although the foaming effects thereof are not as good as when preferred anionic detergents are employed instead of the amphoteric detergent component. However, the bar is a useful washing product and maintains its elasticity throughout repeated washings and dryings.

When the formula is modified so that the weights of all components except the Deriphat 160C are maintained the same and the amount of Deriphat 160C is increased to 68.4 parts, essentially the same type of elastic detergent bar results. Also, when the alum is replaced by urea good elastic detergent bars of essentially the same properties are produced. However, with neither the alum cross-linking agent nor the urea denaturant present products of the described formulation are somewhat more flexible and softer to the touch and may tend to develop more syneresis.

When the formula is modified to replace the sucrose with propylene glycol a useful product of comparable properties is obtained, which is also the situation when the total percentage of glycerine and other dihydric polyhydric compound present (propylene glycol and/or sucrose and/or dextrose) is reduced to 5 and 10%. Reduction of the "plural hydric" alcohol content usually results in firmer or harder gels which are especially satisfactory for the present detergent bars. When the proportion of Deriphat 160C is reduced to 30, 40 and 50% of the product (9, 12 and 15% active ingredient) diminutions in foaming power result but the bar becomes firmer. A similar firming effect is obtained when 300 g. Bloom gelatin is employed instead of that of 225 g. Bloom or when more gelatin is employed. Of course, formula modifications will be made with the guidance of this disclosure to produce the best products for particular applications. In making all the variations of the formula mentioned above the processes employed are the same.

In a modification of such processes, desirably followed, the hot mixture is allowed to stand at an elevated temperature in the range of 45° to 60° C. for a period of one hour so as to allow all air bubbles therein to be dissolved or to rise to the top of the mix and separate therefrom before setting of the gel. The products resulting are brighter and clearer in appearance following such deaeration. Alternatively vacuum may be used, in supplementation or in replacement of the described method.

In further modifications of the procedure small proportions, e.g., 0.01 to 0.5% of dyes and pigments are incorporated to color and opacify the products and the gels are molded in chilled molds into the shapes of storybook characters, cartoon characters and animals, such as green frogs, yellow ducks, brown dogs and orange cats, with the proportions of the dyes and pigments being about 0.02% for dyes and about 0.2% for pigments. The dyed bars are transparent or translucent and the pigmented bars are opaque. The opacities of the pigmented bars are further increased by additions of 1, 2 and 5% of powdered clay to the mix, which also converts the colors to pastels.

EXAMPLE 2

| | Percent |
|---|---|
| Gelatin (225 g. Bloom, Type A) | 10 |
| Glycerin | 15 |
| Sucrose | 7.5 |
| $KAl(SO_4)_2 \cdot 12 H_2O$ | 1.5 |
| Triethanolammonium lauryl sulfate | 12.5 |
| Ethanol | 3.6 |
| Lauric myristic diethanolamide | 3.3 |
| Methyl cellulose | 0.5 |
| Formaldehyde | 0.1 |
| Perfume | 0.2 |
| Other adjuvants and impurities (NaCl, dyes, fluorescent brighteners, triethanolamine, citric acid) | 3.0 |
| Water | 42.8 |

Elastic detergent bars, each 100 g. in weight, are made by the method described in Example 1 (much of the ethanol is evaporated off) and the products resulting are firmly elastic, satisfactory, high foaming detergent bars which emit foam readily upon squeezing. The bars are transparent and light in color but may be made colored and/or opaque by addition of dyes, pigments and insoluble fillers or bodying agents, such as powdered clays, in accordance with Example 1. The detergent bars maintain their good foaming properties during repeated uses and yield up to 200 to 300 normal hand washing uses and up to 10 bath uses per bar. They are mild to the hands and skin (the gelatin content helps), do not slough objectionably, do not excessively bleed or exhibit syneresis and can withstand normal use at ordinary room and wash water temperatures, e.g. 25°–40° C., without loss of shape. When the alum cross-linking agent is replaced by other such cross-linking agents, e.g., equivalent proportions of aluminum chloride, zinc sulfate, magnesium sulfate and/or calcium chloride or by urea or equivalent denaturant similarly firm elastic bar products result. However, when the cross-linking agent and denaturant are omitted from the formula the product is noticeably softer and less desirable for commercial use. Instead of the triethanolammonium lauryl sulfate, diethanolammonium cetyl sulfate may be satisfactorily substituted but when sodium lauryl sulfate is utilized the product resulting is much cloudier in appearance although it is still an elastic gel-type bar. However, when ammonium cocomonoglyceride sulfate or a mixture of equal parts thereof with the corresponding sodium salt is substituted for the triethanolammonium lauryl sulfate good elastic detergent bars are produced.

When the proportions of the various components are varied ±10%, ±20%, ±30%, e.g., by increasing the glycerol content from 15 to 16.5, 18 and 19.5%, while maintaining them within limits given in the specification, similar useful elastic detergent bars result.

EXAMPLE 3

| | Percent |
|---|---|
| Gelatin (225 g. Bloom, Type A) | 10 |
| Glycerol | 5.0 |
| Dextrose | 5.0 |
| Urea | 1.0 |
| Triethanolammonium lauryl sulfate | 15.0 |
| Ethanol | 4.3 |
| Lauric myristic diethanolamide | 4.0 |
| Methyl cellulose | 0.6 |
| Formaldehyde | 0.1 |
| Perfume | 0.2 |
| Other adjuvants and impurities (NaCl, dyes, fluorescent brighteners, triethanolamine, citric acid) | 3.6 |
| Water | 51.2 |

When the above formula is made by the method of Example 1 good elastic detergent bars of the previously described desired properties are obtained.

EXAMPLE 4

The experiments of Example 1 are repeated, with Miranol C2M, anhydrous acid, and triethanolamine (forming the triethanolammonium salt) being substituted for the Deriphat 160 C active ingredient, cross-linking agent, acidifying agent (HCl) and sucrose and with 300 g. Bloom gelatin being substituted for the 225 g. Bloom gelatin. Thus, the mentioned components, totaling 28% of the Example 1 formulation, are replaced with 21% of Miranol C2M and 7% of triethanolamine. The detergent bar made is elastic, form-retaining at normal use temperatures and of satisfactory cleaning power. The triethanolamine also acts as a buffer.

EXAMPLE 5

| | Percent |
|---|---|
| Triethanolammonium lauryl sulfate | 18 |
| Glycerol | 9 |
| Gelatin (225 g. Bloom, Type A) | 9 |
| Potassium alum | 1 |
| Sodium carboxymethyl cellulose | 0.1 |
| Polyvinyl pyrrolidone | 0.1 |
| Carbowax 600 (polyethylene glycol) | 4 |
| Water | 58.8 |

EXAMPLE 6

| | Percent |
|---|---|
| Triethanolammonium lauryl sulfate | 18 |
| Glycerol | 5 |
| Gelatin (225 g. Bloom, Type A) | 9 |
| Potassium alum | 1 |
| Sodium carboxymethyl cellulose | 0.1 |
| Polyvinyl pyrrolidone | 0.1 |
| Carbowax 600 | 8 |
| Water | 58.8 |

EXAMPLE 7

| | Percent |
|---|---|
| Triethanolammonium lauryl sulfate | 18 |
| Gelatin (225 g. Bloom, Type A) | 9 |
| Potash alum | 1 |
| Polyvinyl pyrrolidone | 0.5 |
| Carbowax 600 | 10 |
| Water | 61.5 |

The molded elastic detergent bar products of Examples 5–7, made by the method of Example 1, are good detersive bar products, satisfactory for bath use and hand washing. They are of stable form, continue to be elastic during use and foam well. Although these bars may have a slight tackiness on the surface thereof, as do some of the other products of this invention, such may be corrected by dusting with talc, starch or other similar agent. Similar bars result with Type B gelatin.

The invention has been described with respect to various embodiments and illustrations thereof but is not to be limited to these because it is evident that one of skill in the art with the present specification before him will be able to utilize substitutes and equivalents without departing from the spirit of the invention.

What is claimed is:

1. A hand squeezable, elastic, solid molded detergent product comprising about 10 to 80% of a synthetic organic detergent selected from the group consisting of anionic sulfated and sulfonated synthetic organic detergents and amphoteric synthetic organic detergents, said anionic sulfated and sulfonated synthetic organic detergents being water soluble and selected from the group consisting of alkali metal, triethanolamine and ammonium linear higher alkylbenzene sulfonates, paraffin sulfonates, olefin sulfonates, higher fatty alcohol sulfates, monoglyceride sulfates and higher fatty alcohol polyethylene glycol sulfates and mixtures thereof and the amphoteric detergent being water soluble and selected from the group consisting of betaaminopropionates, betaiminodipropionates and imidazolium salts and mixtures thereof, about 5 to 30% of gelatin, about 5 to 60% of water and about 1 to 5% of a compound selected from the group consisting of cross-linking agents and denaturing agents for the gelatin and mixtures thereof when the synthetic organic detergent is an anionic detergent, which product is sufficiently squeezable and elastic so that a 2 cm. thickness thereof can be pressed between a thumb and forefinger to a 1 cm. thickness and upon release of such pressure will return within five seconds to within 1 mm. of the 2 cm. thickness.

2. A squeezable, elastic, solid molded detergent product according to claim 1 comprising about 10 to 70% of amphoteric synthetic organic detergent, about 5 to 30% of gelatin and about 5 to 60% of water.

3. An elastic detergent product according to claim 2 wherein the amphoteric detergent is selected from the group consisting of imidazolinium betaines and betaiminodipropionates and mixtures thereof and the gelatin is a type A gelatin of 100 to 300 g. Bloom.

4. An elastic detergent product according to claim 3 which comprises about 15 to 50% of a partial sodium salt of N-lauryl betaiminodipropionate, 7 to 25% of gelatin of 200 to 300 g. Bloom, 3 to 20% of glycerol and 5 to 45% of water.

5. An elastic detergent product according to claim 1 wherein the gelatin is a type A gelatin of 100 to 300 g. Bloom, the cross-linking agent is a salt of a metal selected from the group consisting of aluminum, calcium, magnesium and zinc and the denaturant is urea.

6. An elastic detergent product according to claim 5 which comprises about 15 to 50% of an anionic synthetic organic detergent selected from the group consisting of alkali metal monoglyceride sulfate, ammonium monoglyceride sulfate, triethanolammonium higher fatty alcohol sulfate and mixtures thereof, 7 to 25% of gelatin, which is of 200 to 300 g. Bloom, 0.1 to 3% of cross-linking agent, which is an aluminum salt, 3 to 20% of lower dihydric or polyhydric alcohol and 5 to 45% of water.

7. An elastic detergent product according to claim 6 which comprises about 25% of ammonium monoglyceride sulfate, about 10% of 225 g. Bloom gelatin, about 1.5% of $KAl(SO_4)_2.12\ H_2O$, about 15% of propylene glycol and about 40% of water.

8. An elastic detergent product according to claim 1 wherein the synthetic organic detergent is an amphoteric synthetic organic detergent.

9. An elastic detergent product according to claim 8 which comprises about 15 to 50% of an amphoteric synthetic organic detergent selected from the group consisting of 1-carboxymethyl-1-carboxyethoxyethyl-2-coco-imidazolinium betaine and water soluble salts thereof, and sodium salts of N-lauryl betaiminodipropionate and mixtures thereof, 7 to 25% of gelatin, which is of 200 to 300 g. Bloom, 3 to 20% of lower dihydric or polyhydric alcohol and 5 to 45% of water.

10. An elastic detergent product according to claim 9 which comprises about 20% of a sodium salt of N-lauryl betaiminodipropionate, about 10% of 300 g. Bloom gelatin, about 1.5 of $KAl(SO_4)_2.12\ H_2O$, about 15% of glycerol and about 15% of water.

* * * * *